US007845743B2

(12) United States Patent
Pons

(10) Patent No.: US 7,845,743 B2
(45) Date of Patent: Dec. 7, 2010

(54) APPLIED MOLDING FOR TEXTURIZING EXTERIOR SURFACES OF FURNITURE

(75) Inventor: Luis G. Pons, Miami, FL (US)

(73) Assignee: Aponwao Design Inc., Washington, DC (US)

( * ) Notice: Subject to any disclaimer, the term of this patent is extended or adjusted under 35 U.S.C. 154(b) by 463 days.

(21) Appl. No.: 11/798,410

(22) Filed: May 14, 2007

(65) Prior Publication Data

US 2007/0296319 A1 Dec. 27, 2007

Related U.S. Application Data

(60) Provisional application No. 60/799,662, filed on May 12, 2006.

(51) Int. Cl.
*A47B 97/00* (2006.01)

(52) U.S. Cl. ..... 312/204

(58) Field of Classification Search ..... 312/204, 312/265.5, 265.6, 107, 108, 111, 330.1, 348.4
See application file for complete search history.

(56) References Cited

U.S. PATENT DOCUMENTS

| | | | | | |
|---|---|---|---|---|---|
| 370,467 | A * | 9/1887 | Gaudin | 312/209 |
| 920,937 | A * | 5/1909 | Evans | 312/107 |
| 2,198,077 | A * | 4/1940 | Curtis | 362/147 |
| 3,016,275 | A * | 1/1962 | Grant | 312/209 |
| 3,023,910 | A * | 3/1962 | Schless et al. | 211/162 |
| D200,017 | S * | 1/1965 | Williams | D3/296 |
| 3,206,904 | A * | 9/1965 | Cripe | 52/843 |
| 3,301,622 | A * | 1/1967 | Dasovic et al. | 312/245 |
| 3,608,261 | A * | 9/1971 | French et al. | 52/316 |
| 4,021,089 | A * | 5/1977 | Bush | 312/265.5 |
| 4,084,125 | A * | 4/1978 | King | 312/199 |
| D255,237 | S * | 6/1980 | Frick | D14/440 |
| D312,360 | S * | 11/1990 | Greenfield | D6/445 |
| 4,973,109 | A * | 11/1990 | Diedrich | 312/114 |
| 5,176,435 | A * | 1/1993 | Pipkens | 312/204 |
| 5,230,551 | A | 7/1993 | Kramer | |
| D339,252 | S * | 9/1993 | Martinez, Sr. | D6/445 |
| 5,456,555 | A | 10/1995 | Bökeler | |
| D369,251 | S * | 4/1996 | Williamson-Markman | D6/434 |
| 5,507,570 | A * | 4/1996 | Williams et al. | 312/249.9 |
| 5,632,540 | A | 5/1997 | Wilcox | |
| 6,415,552 | B1 * | 7/2002 | Khosropour | 52/27 |
| 6,550,880 | B2 | 4/2003 | Reuter | |
| D588,376 | S * | 3/2009 | Simone | D6/441 |
| 2002/0018907 | A1 * | 2/2002 | Zehner | 428/537.1 |
| 2003/0091784 | A1 * | 5/2003 | Nykamp et al. | 428/99 |

* cited by examiner

*Primary Examiner*—Janet M Wilkens
(74) *Attorney, Agent, or Firm*—DLA Piper LLP (US)

(57) ABSTRACT

Methods of applying multiple parallel frames or moldings to planar surfaces on articles of furniture are disclosed to produce multi-banded, textured exterior surfaces on articles which conceal functionalities such as, doors, shelves, or receptacles, as well as one or more slide-ably extendable/retractable drawers, to include articles of furniture made by the disclosed methods.

16 Claims, 9 Drawing Sheets

APPLIED MOLDING FOR TEXTURIZING EXTERIOR SURFACES OF FURNITURE

CROSS REFERENCE TO RELATED APPLICATIONS

This application is based on, and claims priority to, U.S. Provisional Application Ser. No. 60/799,662, filed May 12, 2006, the entire contents of which are hereby incorporated by reference.

BACKGROUND

1. Field of the Invention

The invention relates generally to methods for making articles of furniture including the articles themselves and, more specifically, to the use of multiple parallel frames to produce multi-banded, textured exterior surfaces on articles of furniture such as credenzas, armoires, cabinets, tables, and desks, where such textured surfaces conceal functionalities comprising the articles.

2. Discussion of the Background

Solid wood provides aesthetic qualities that are desirable to many consumers and therefore preferred for various objects of furniture. Generally, articles of furniture, such as desks armoires, credenzas, etc., comprise simple rectangular shapes, with smooth planar exteriors, or may comprise contoured surfaces simulating, for example, stiles, rails, panels, and other features found in traditional wooden furniture articles. Further, the exterior surfaces of articles of furniture typically lack three-dimensionality, and are devoid of the ornate and delicately intricate patterns associated with structural woodwork usually found in wood moldings and picture frames.

Distinctive wood furniture objects hold a significant and expanding share of design options that complement the changing variety of architectural styles. However, present furniture designs lack surfaces that exploit the visual nuances that accompany the art of shaping and assembling structural woodwork associated with more intricate carpentry found only in ornate wood moldings. Further, even where such designs might be attempted, there is a consequential loss of everyday functionality or loss in aesthetic quality if functionality is preserved.

It is therefore desirable to provide a method of producing articles of furniture which comprise textured exterior surfaces associated with ornate wood moldings and yet retain the functionality of everyday furniture.

SUMMARY

The present invention relates to methods of applying multiple parallel frames to planar surfaces on articles of furniture to produce multi-banded, textured exterior surfaces on articles which conceal functionalities such as, for example, doors, shelves, or receptacles, as well as one or more slideably extendable/retractable drawers, to include articles of furniture made by the disclosed methods.

The articles of furniture described herein are particularly useful in providing ornate, wood molded surfaces to the exterior surfaces of credenzas, armoires, cabinets, tables, chest of drawers, desks, and the like. The articles of furniture are comprised of multiple parallel frames, where the frames include, but are not limited to, picture frames, door frames or the like, which frames are applied to exterior planar surfaces on the front, back, and sides of the articles.

Each frame is composed of sculpted or molded woodwork, including combinations thereof, as a visually continuous band which surrounds the article of furniture, which when combined with other frames, results in a multi-banded pattern that covers the exterior planar surfaces of the article. Intermittent bands may also be applied to the surfaces, where such intermittent bands may be between the wooden frames, inlaid on the wooden frames, or may delimit the corners of the articles, which intermittent bands may comprise other ornamental materials such as marble, glass, and the like. Further, such multi-banded patterns may comprise frames having separate and distinct patterns, colors, ornate materials, or designs such that each frame is different. Alternatively, each frame comprising a band may be the same.

Each frame may be vertically parallel or horizontally parallel relative to the planar axis of the surface on which the article rests (e.g., the floor or the ground). In one aspect, each band making up the exterior surface is a visually contiguous frame, for example, resembling a picture frame. In a related aspect, the frames are molded frames, beveled, or ornately sculpted.

The functionalities making up the article may extend horizontally away from the body of the article, between a first sidewall and a second sidewall of the article and/or swing on a hinge in an arc away from the front wall of the article. In one aspect, the functionalities are covered by multiple frames that comprise side edges which form beveled ends or edges forming angles that fit the parallel bands of the multiple frames together, resulting in a visually integral surface when the functionality is closed, thus concealing the functionality. In one aspect, the functionality is a door, where the door is configured to be in front of the other functionalities, such as a set of drawers or shelves. In a related aspect, the exterior surfaces comprising the drawers behind the door are smooth or may comprise other ornamental features. In another aspect, the front walls of the drawers make up the exterior surface of the article to which the frames are applied. In a related aspect, the drawers are configured as tiers, where the edges for the first sidewall, the second sidewall, and front wall of the drawers are mitered, thus concealing the draws as visually integral frames within the multi-banded exterior surfaces when the drawers are closed. In another aspect, the functionalities are substantially between a first sidewall and a second sidewall, or are between sets of other functionalities, where the edges of the functionalities are substantially flat and perpendicular to the bottom edge of the article. Essentially, the angle of the edge of the functionality is determined by whether it is concealed by a second functionality, its position relative to the delimiting edge of the article, or whether the functionality itself delimits the edge of the article.

The frames may be applied by any means known in the art including application by adhesion, fasters, or combinations thereof.

BRIEF DESCRIPTION OF THE DRAWINGS

The application file contains at least one drawing executed in color. Copies of this patent application publication with color drawings will be provided by the Office upon request and payment of the necessary fee.

For a better understanding of the invention, reference may be had to the following description taken in conjunction with the accompanying drawings, wherein.

DETAILED DESCRIPTION

Before the present articles and methods are described, it is to be understood that this invention is not limited to particular articles and methods described, as such articles and methods may vary. It is also to be understood that the terminology used herein is for purposes of describing particular embodiments only, and is not intended to be limiting.

As used in this specification, the singular forms "a", "an", and "the" include plural references unless the context clearly dictates otherwise. Thus, for example, references to "the method" includes one or more methods, and/or steps of the type described herein which will become apparent to those persons skilled in the art upon reading this disclosure and so forth.

Unless defined otherwise, all technical and scientific terms used herein have the same meaning as commonly understood by one of ordinary skill in the art to which this invention belongs. Although any methods and materials similar or equivalent to those described herein can be used in the practice or testing of the invention, the preferred methods and materials are now described. All publications mentioned herein are incorporated herein by reference in their entirety.

As used herein the term "functionality," or grammatical variations thereof, means a component designed or developed chiefly from the point of view of use. For example, drawers, cubby holes, shelves, bins, doors, cabinets, platforms, and the like, would be considered functionalities.

The structures of credenzas, armoires, cabinets, tables, desks, and the like, to which the frames are applied are well known in the art (see, e.g., U.S. Pat. Nos. 6,550,880; 5,632,540; 5,456,555).

Figure 1:
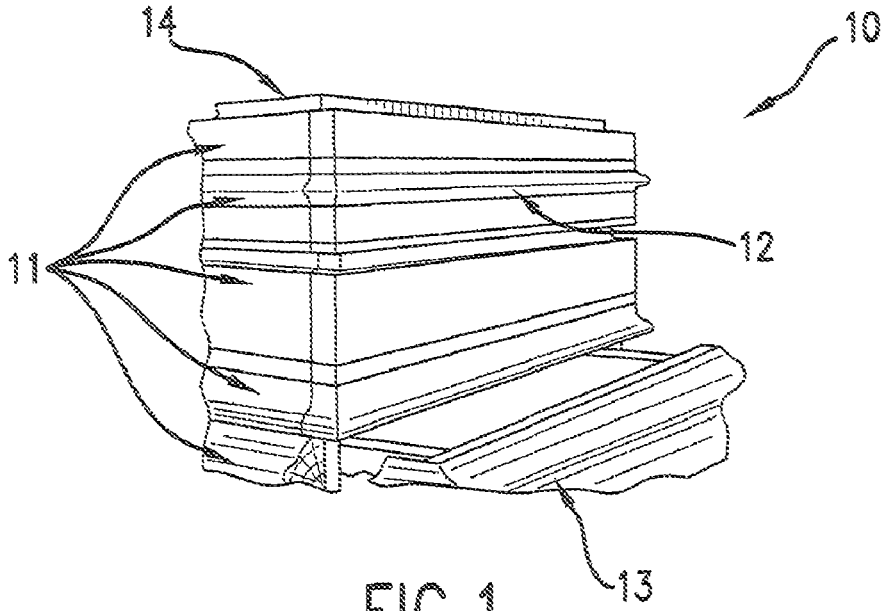
FIG. 1 is a perspective view of a stand having horizontally parallel multi-banded frames, where the top drawer is closed and the bottom is in an open position.

Referring initially to FIG. 1, a stand 10 comprises applied multiple horizontal, monochrome, molded picture frames (or moldings) 11 applied on the exterior surface, which stand contains a plurality of drawers 12, 13. The frames 11 on the front of the drawers extend across an entire width of the stand 10 and are aligned with matching frames on sides of the stand 10. The vertical group 119 between the frames 11 attached to the drawers 12, 13 and the frames 11 attached to the side of the stand 10 are not visible when the stand 10 is viewed from the front. Moreover, the horizontal gap 116 between the frames 11 that are the nearest neighbors on adjoining drawers are also narrow, preferably substantially a same distance as a gap between neighboring frames 11 on a same drawer front. The foregoing features cooperate to conceal the drawers 12, 13 when the stand 10 is viewed from the front. As seen in FIG. 1, the frames 11 vary vertically or in a direction perpendicular to a principal axis, but are uniform horizontally or along a principal axis of the frames 11. Also shown, is that the frames 11 can serve as a support for platforms comprising the top wall 14 of the article. For purposes of brevity, further references to "drawers" may only describe a single drawer, although those skilled in the art know that any number of draws can be used in a table, chest, or stand.

Figure 2:
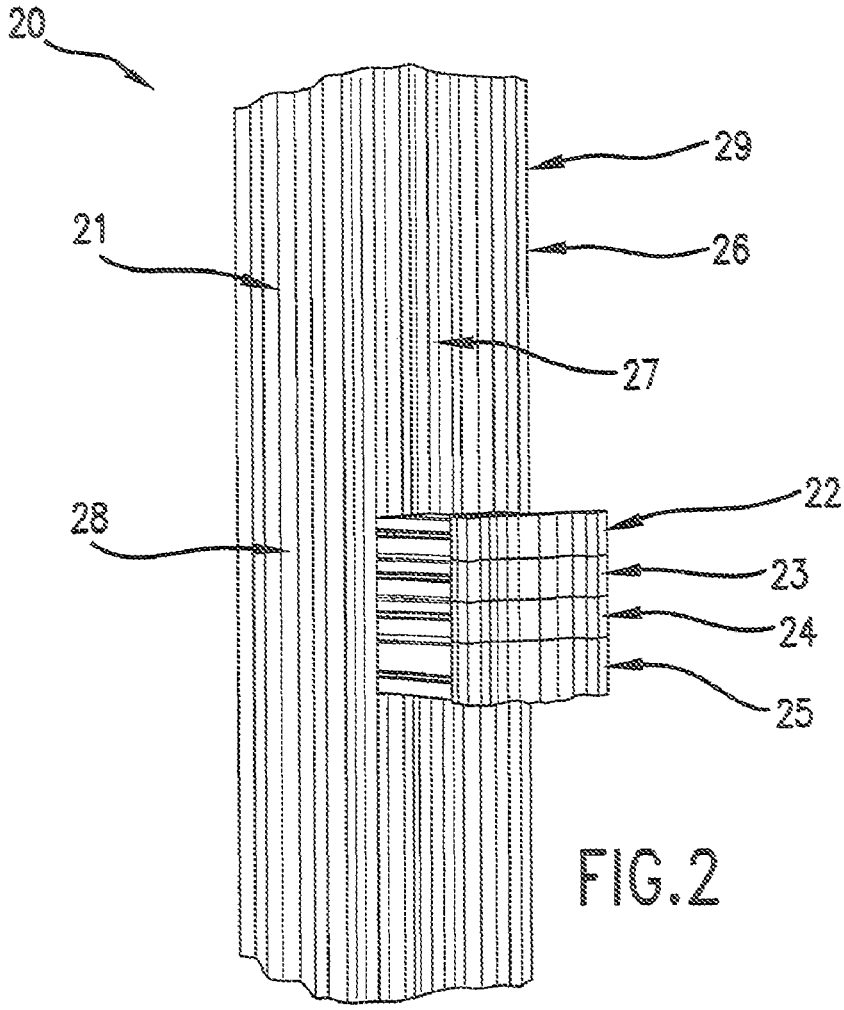
FIG. 2 is a perspective view of a chest of drawers having vertically parallel multi-banded frames, where the drawers are horizontally extended (evenly) away from the article (i.e., in the open position)

Referring to FIG. 2, a chest of drawers 20 is shown comprising applied multiple vertical, multicolored, molded picture frames 21 on the exterior surface, which chest contains a plurality of extended drawers 22, 23, 24, 25. Here, the drawers 22, 23, 24, 25 delimit an edge 26 of the front wall 27 and a sidewall 28 of the chest of drawers 20. The drawers 22, 23, 24, 25 are slide-ably extendable/retractable away from the front wall 27 of the article 20. The drawers 22, 23, 24, 25 may be operatively connected to the first 28 and second 29 sidewalls of the chest 20 to achieve slide-ability by any means known in the art (see, e.g., U.S. Pat. No. 5,230,551). In this figure, the drawers 22, 23, 24, 25 are evenly extended. The frames on the fronts of the drawers 22, 23, 24, 25 are of the same shape, color and orientation as the frames on the corresponding moving and stationary portion of the chest 20, and the gaps between them are small. This feature also helps to obscure or conceal the existence of the drawers 22, 23, 24, 25.

Figure 3:
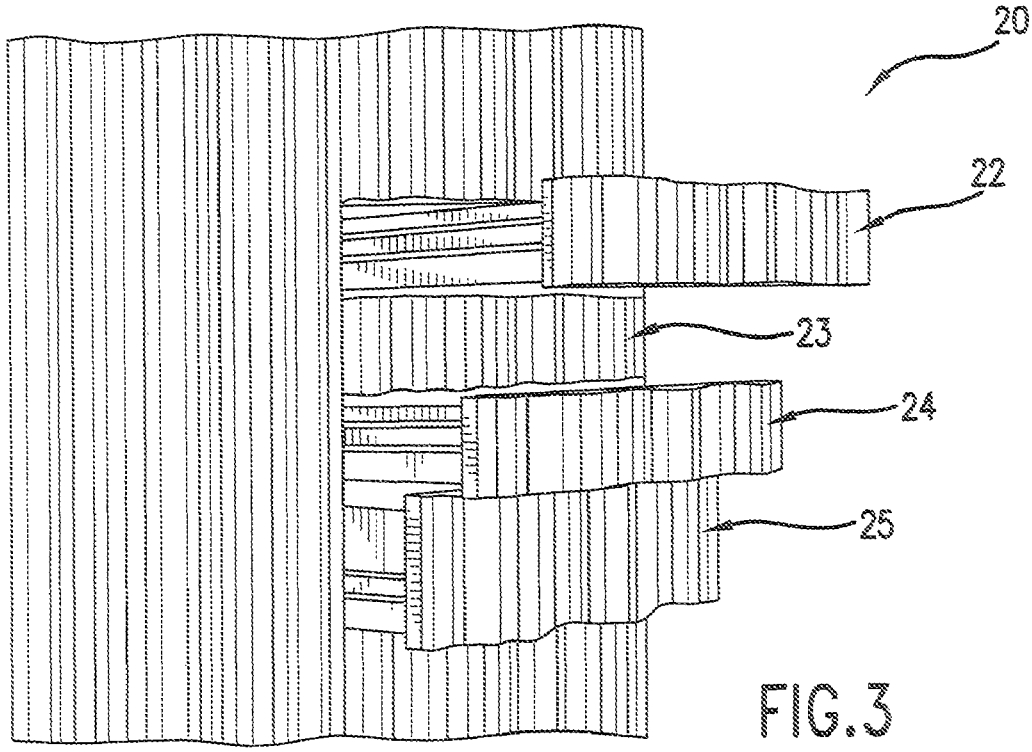
FIG. 3 is another perspective view of the chest of drawers of FIG. 2, where the drawers are extended (i.e., staggered) away from the article (i.e., in the open position)

Referring to FIG. 3, the chest of drawers 20 is shown with the drawers 22, 23, 24, 25 in a staggered configuration, thereby demonstrating the slide-ably extendable/retractable function of the drawers 22, 23, 24, 25 of the article 20.

Figure 4:
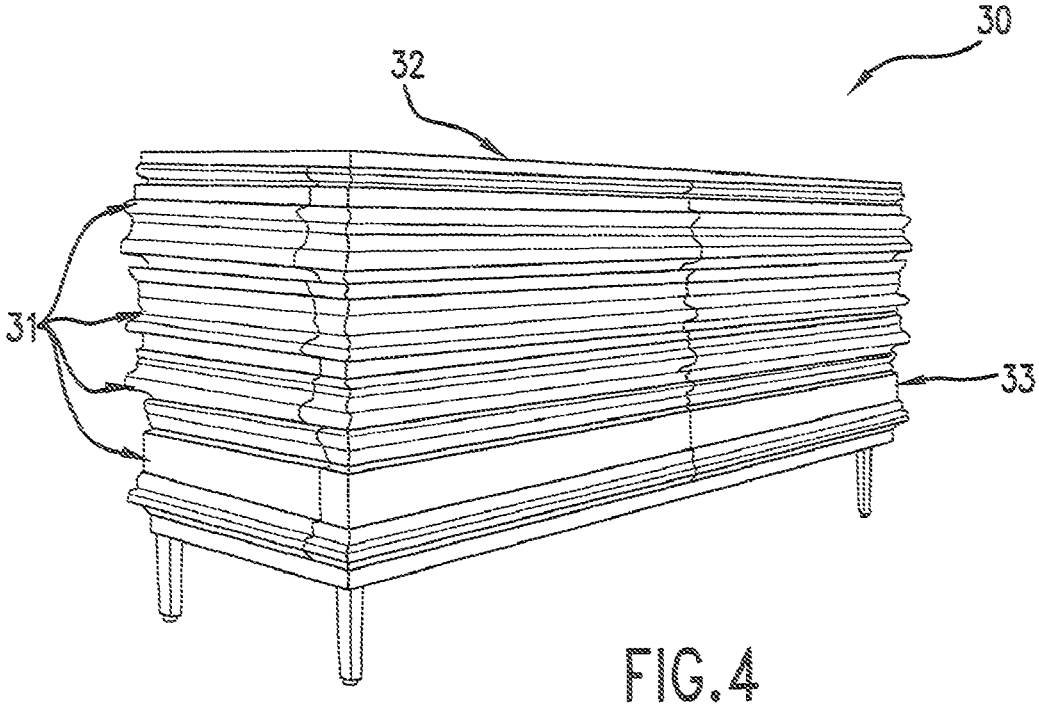
FIG. 4 is a perspective view of a chest of drawers having horizontally parallel multi-banded frames, where the functionalities are concealed (i.e., in the closed position). Also shown is a platform/stand (comprising wood) on which the chest rests.

Referring to FIG. 4, a chest of drawers 30 is shown comprising applied multiple horizontal, multicolored, molded picture frames 31 on the exterior surface, which chest 30 contains a plurality of concealed drawers. Here the drawers are covered by multiple frames 31 that comprise side edges 32 which form beveled ends or edges, thus forming angles that fit the parallel bands 33 of the multiple frames 31 together, resulting in a visually integral surface when the drawers are closed, thus concealing the drawers.

Figure 5:
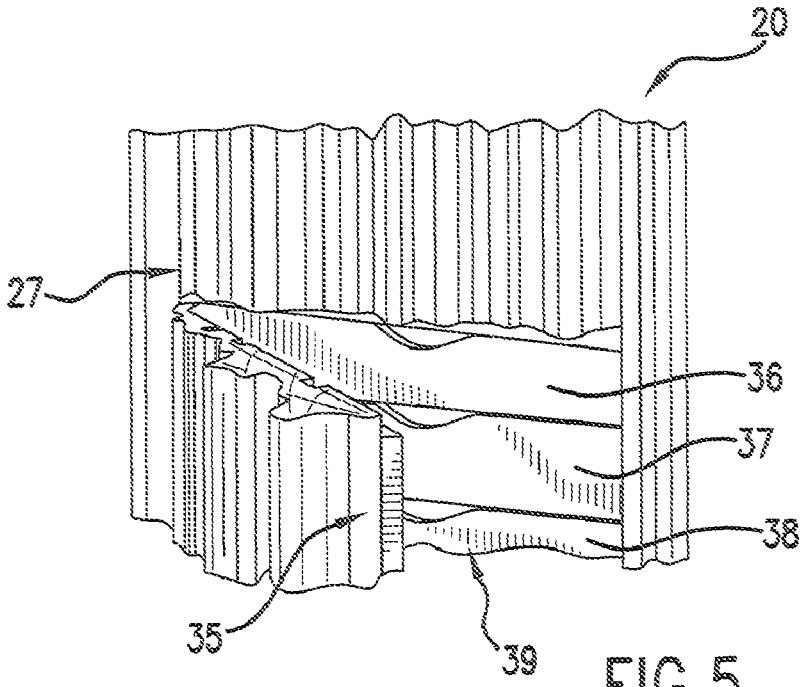
FIG. 5 is another perspective view of a chest of drawers having vertically parallel multi-banded frames, showing a door on a hinge swung in an arc away from the front wall of the article (i.e., in the open position), the exterior surface of which comprises frame segments, and behind which, additional drawers are concealed.

Referring to FIG. 5, is another view of the chest of draws 20 of FIG. 2 showing a door 35 which is operatively connected to the front wall 27. The door 35 conceals another set of draws 36, 37, 38, where the exterior surfaces comprising the drawers 36, 37, 38 behind the door 35 are of a different texture than the exterior surface 40 of the door 35.

Figure 6:
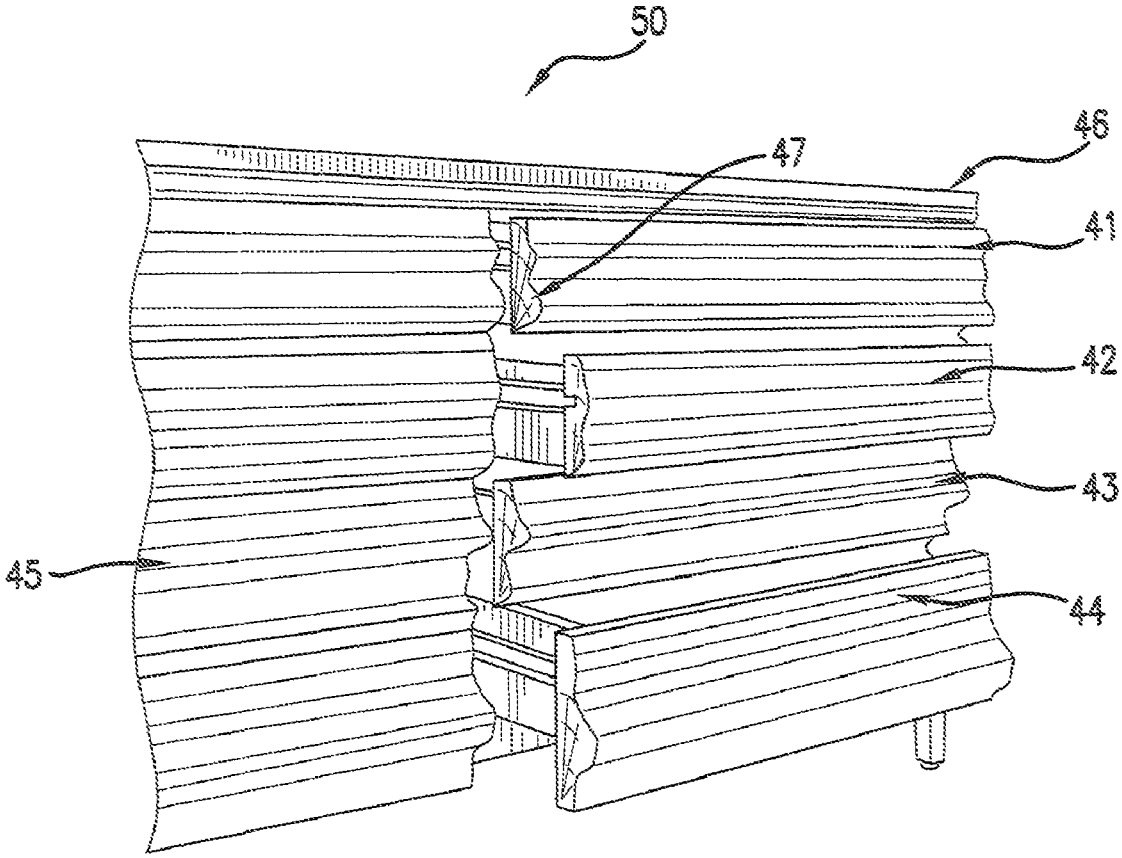
FIG. 6 is a perspective view of a chest of drawers having horizontally parallel multi-banded frames, where the draws are extended (i.e., staggered) away from the article (i.e., in the open position)

Referring to FIG. 6, the chest of drawers 50 is shown with the drawers 41, 42, 43, 44 in a staggered configuration, again demonstrating the slide-ably extendable/retractable function of the article 50. The drawers 41, 42, 43, 44 are substantially between a first sidewall 45 and a second sidewall 46 and operatively connected to the first sidewall 45 and an intermediate spacer, where the edges 47 of the functionalities are substantially flat and perpendicular to the bottom edge of the article 48.

Figure 7:
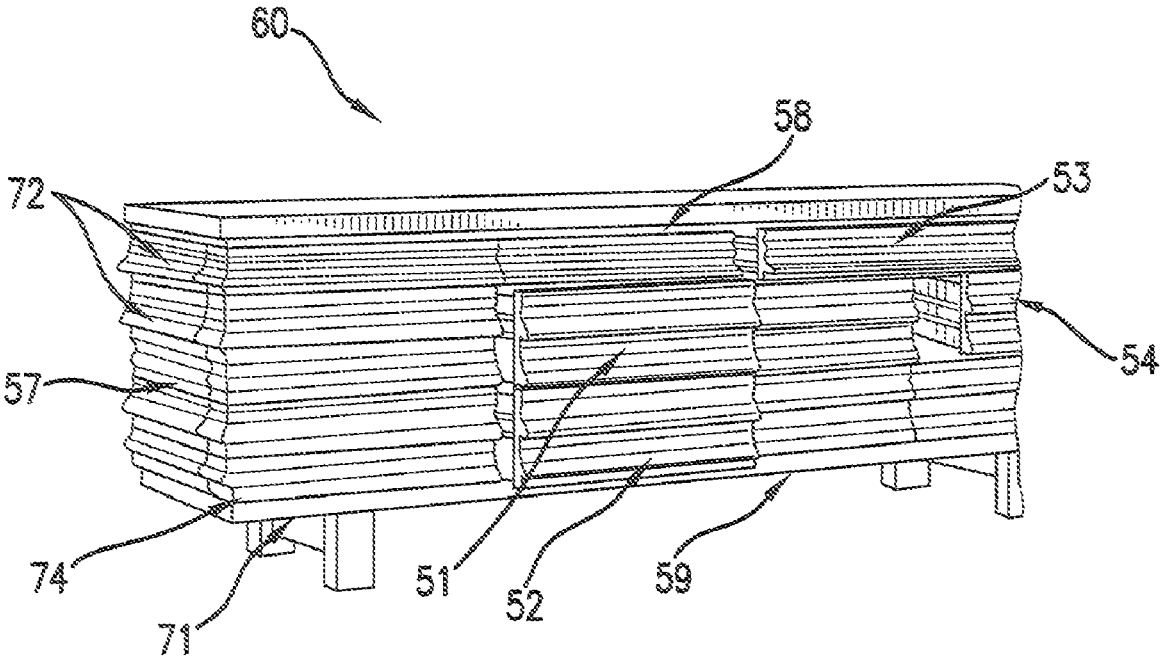
FIG. 7 is another perspective view of the chest of drawers of FIG. 6, showing concealed draws in the open position (i.e., staggered), where the drawers are substantially between a first sidewall and a second sidewall of the article, and where the edges of the drawers are substantially flat and perpendicular to the bottom edge of the chest of drawers. Also shown is a platform/stand (comprising glass and metal) on which the chest of drawers rests.

Referring to FIG. 7, a chest of drawers 60 is shown with the drawers 51, 52, 53, 54 open in various configurations. The drawers 51, 52 are substantially between a first sidewall 57 and other drawers 53, 54, operatively connected to the first sidewall 57 and an intermediate spacer between drawers 51, 52 and 53, 54, where the edges 58 of the drawers 51, 52, 53, 54 are substantially flat and perpendicular to the bottom edge 59 of the article 60. The chest 60 rests on a platform 71. In addition to wood frames 72, the multi-banded parallel frames also contain intermittent ornamental materials 74.

Figure 8:
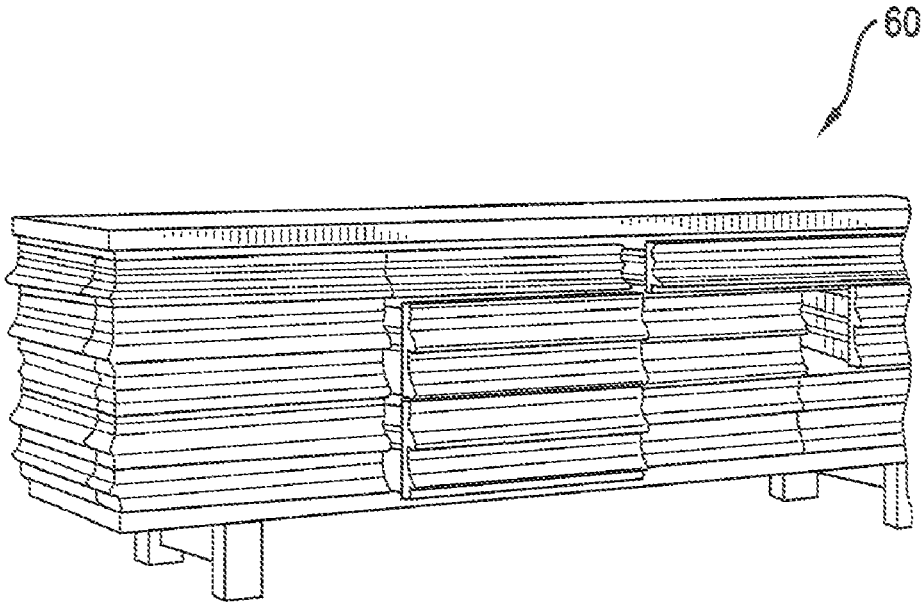
FIG. 8 is another perspective view of the chest of drawers of FIG. 6, showing concealed draws in the open position (i.e., staggered), where the drawers are substantially between a first sidewall and a second sidewall of the article, and where the edges of the drawers are substantially flat and perpendicular to the bottom edge of the chest of drawers. Also shown is a platform/stand (comprising glass and metal) on which the chest of drawers rests.
Figure 9:
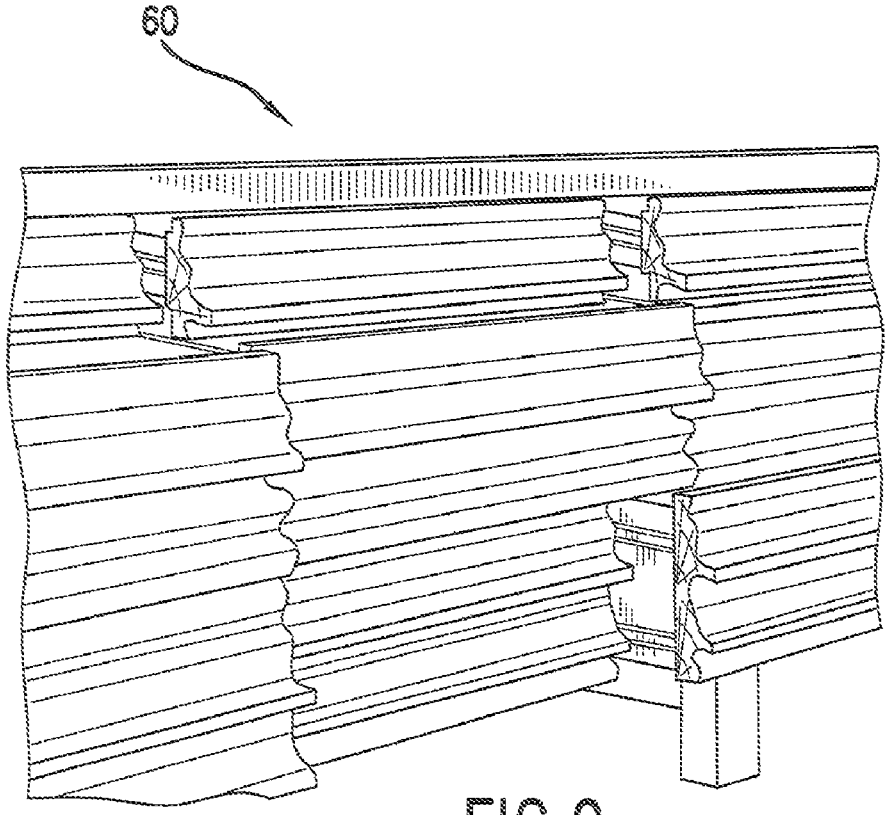
FIG. 9 is another perspective view of the chest of drawers of FIG. 6, showing concealed draws in the open position (i.e., staggered), where the drawers are substantially between a first sidewall and a second sidewall of the article, and where the edges of the drawers are substantially flat and perpendicular to the bottom edge of the chest of drawers. Also shown is a platform/stand (comprising glass and metal) on which the chest of drawers rests.
Figure 10:
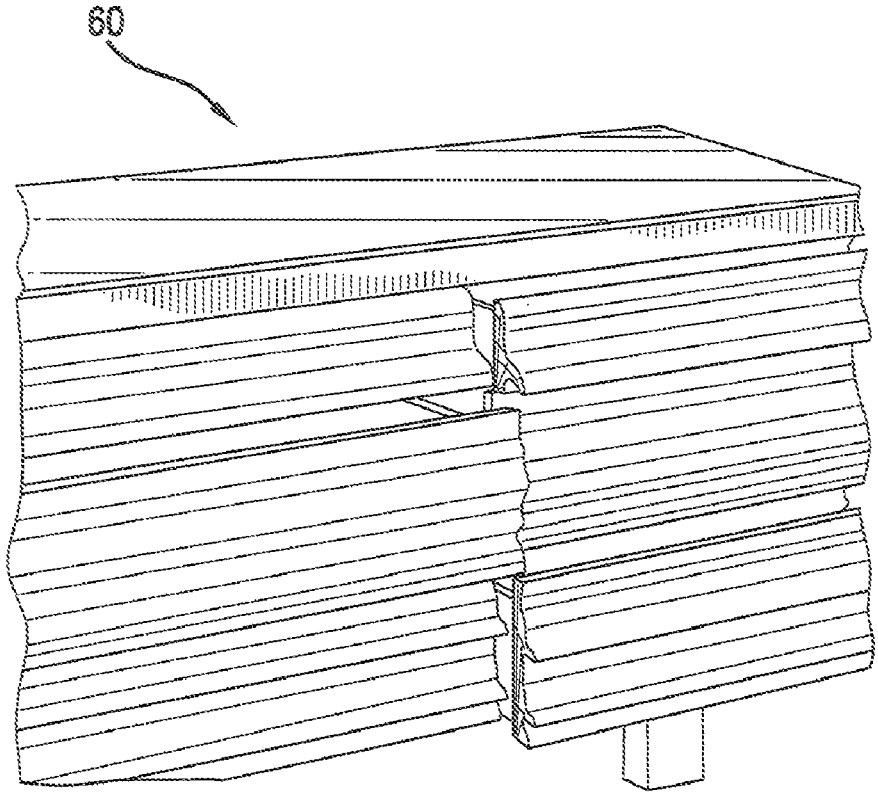
FIG. 10 is another perspective view of the chest of drawers of FIG. 6, showing concealed draws in the open position (i.e., staggered), where the drawers are substantially between a first sidewall and a second sidewall of the article, and where the edges of the drawers are substantially flat and perpendicular to the bottom edge of the chest of drawers. Also shown is a platform/stand (comprising glass and metal) on which the chest of drawers rests.
Figure 11:
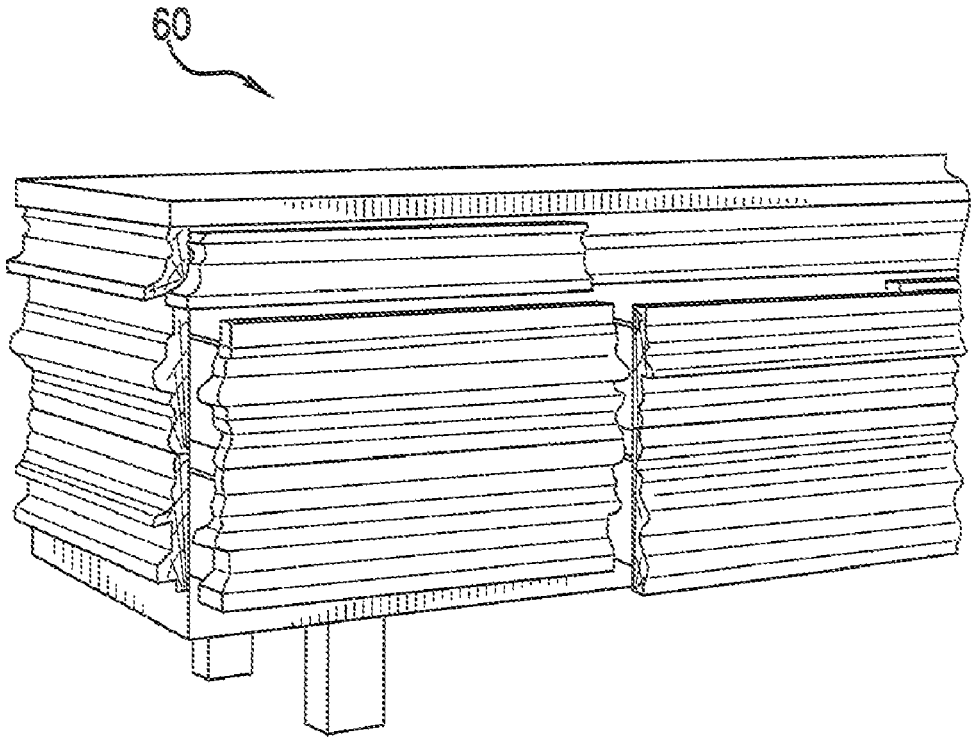
FIG. 11 is another perspective view of the table of FIG. 6, showing concealed draws in the open position (i.e., staggered), where the drawers are substantially between a first sidewall and a second sidewall of the chest of drawers, and where the edges of the drawers are substantially flat and perpendicular to the bottom edge of the table. Also shown are drawers that delimit the chest of draws, where the edges for the first sidewall and front wall of the drawers are mitered, thus concealing the draws as visually integral frames within the multi-banded exterior surfaces when the drawers are closed, as well as a platform/stand (comprising glass and metal) on which the chest of drawers rests.
Figure 12:
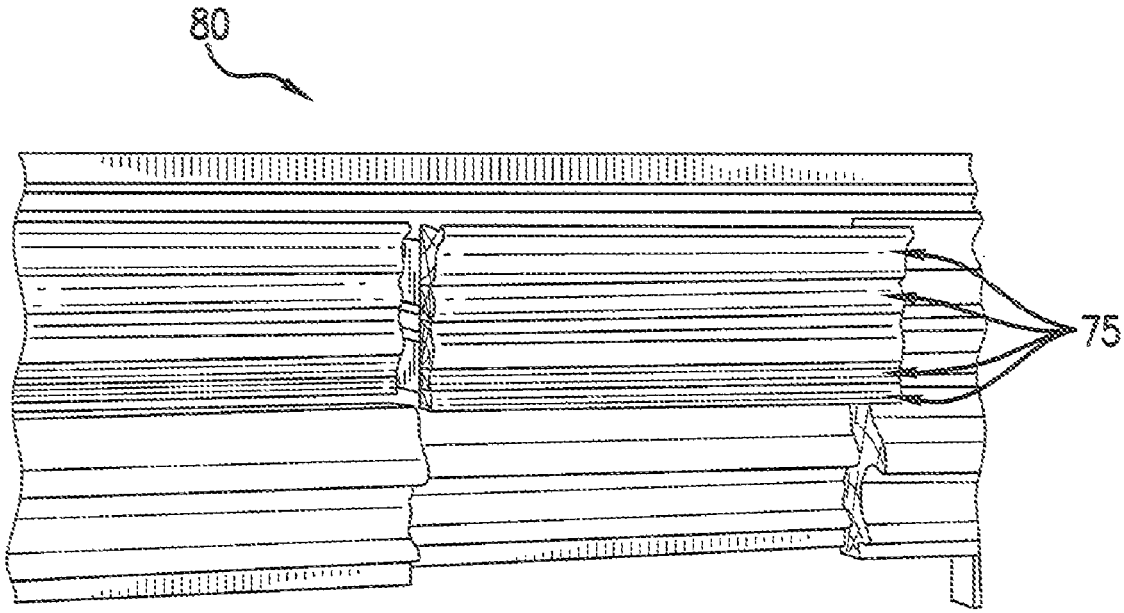
FIG. 12 is a perspective view of a table, showing draws in the open position (i.e., staggered), where the drawers are substantially between a first sidewall and a second sidewall of the article, and where the edges of the drawers are substantially flat and perpendicular to the bottom edge of the table.

FIG. 8 shows the same chest of drawers 60, with different background light. FIGS. 9-11 show close-up views of the chest 60. FIG. 12, shows a similar chest 80 to the chest 60 of FIGS. 8-11, where each frame 75 is a different color.

Figure 13:
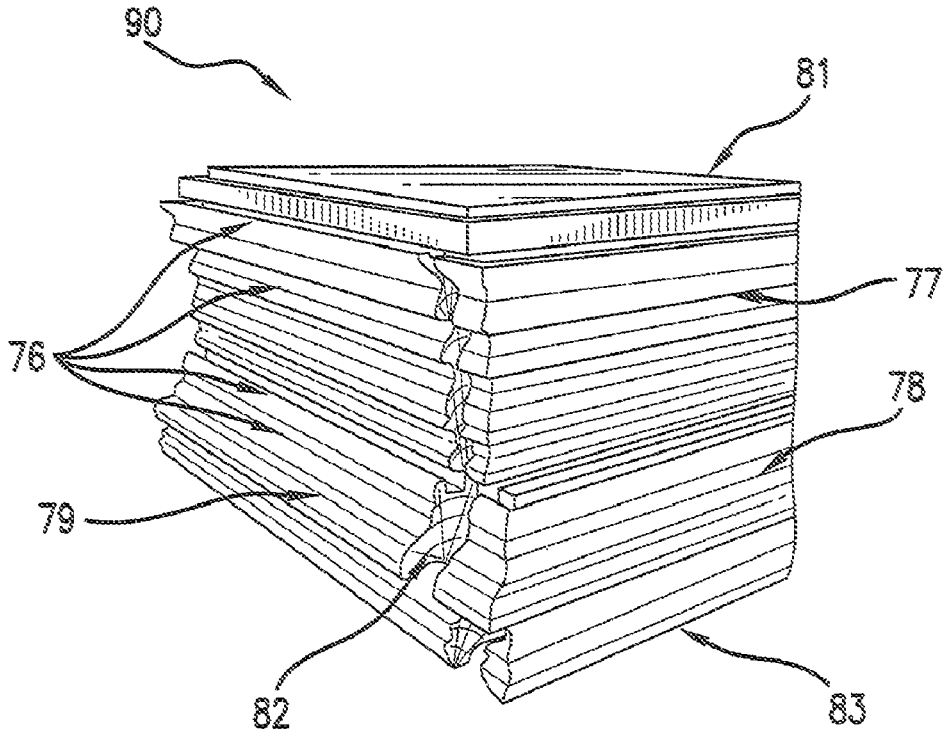
FIG. 13 is a perspective view of a night stand, showing draws in a slightly open position (i.e., ajar), where the drawers are substantially between a first sidewall and a second sidewall of the article, and where the edges of the drawers are substantially flat and perpendicular to the bottom edge of the night stand.

FIG. 13 shows a night stand 90 comprising applied multiple horizontal, multicolored, molded picture frames 76 where the drawers 77, 78 are substantially between and operatively connected to a first sidewall 79 and a second sidewall 81 of the article 90, and the edges 82 of the drawers 77, 78 are substantially flat and perpendicular to the bottom edge 83 of the night stand 90.

Figure 14:
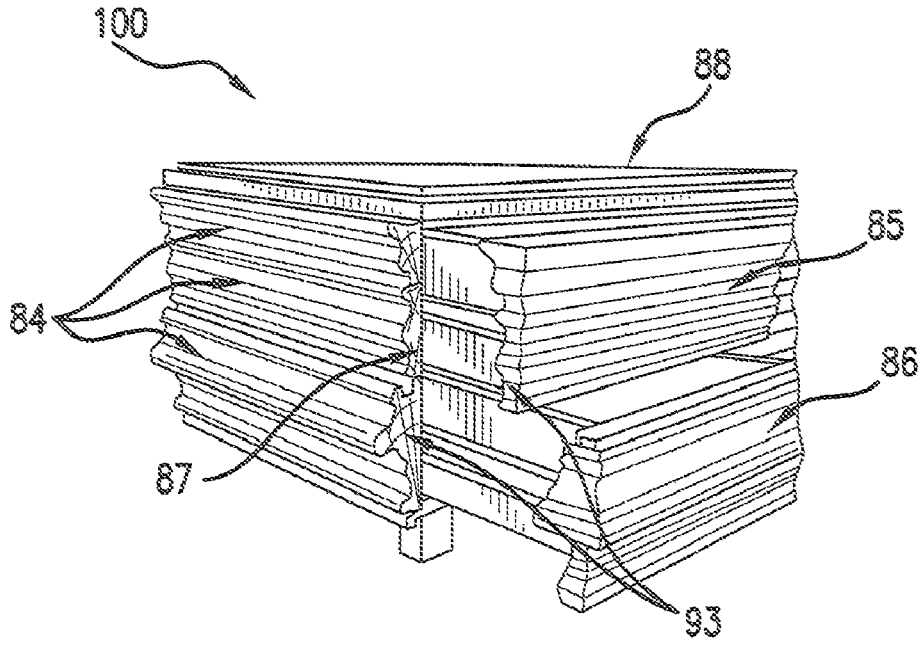
FIG. 14 is a perspective view of a night stand, showing draws in a slightly open position (i.e., staggered), where the drawers themselves delimit the edge of the front wall of the article, and where the edges form beveled ends that fit the parallel bands of the multiple frames together, resulting in a visually integral surface when the drawers are closed, thus concealing the drawers.

FIG. 14 shows a night stand 100 comprising applied multiple horizontal, multicolored, molded picture frames 84 where the drawers 85, 86 are substantially between and operatively connected to a first sidewall 87 and a second sidewall 88 of the article 100, and the drawers 85, 86 delimit the edge 91 of the front wall 92 of the article 100, and where the edges of the delimiting edges 93 form a bevel that fits the parallel bands of the multiple frames 84 together, resulting in a visually integral surface when the drawers 85, 86 are closed, thus concealing the drawers 85, 86.

Figure 15:
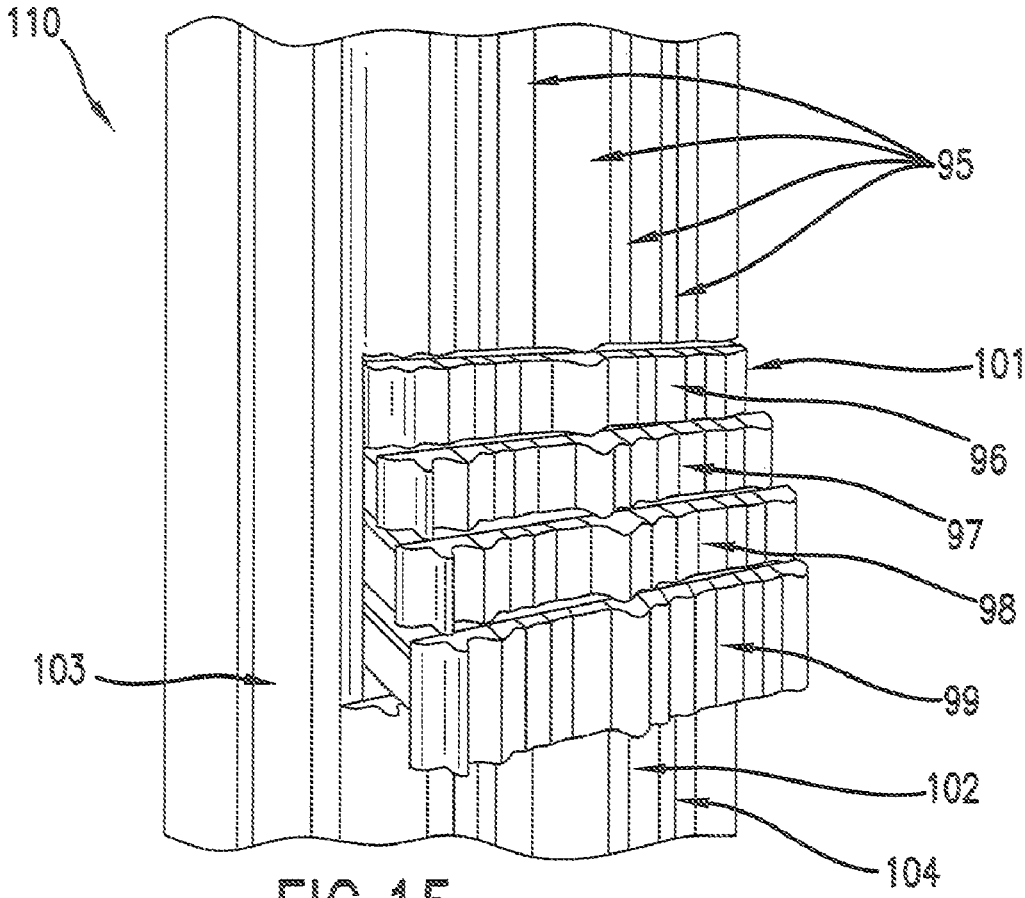
FIG. 15 is a perspective view of a chest of drawers having vertically parallel, multi-colored, multi-banded frames, where the drawers are horizontally extended (i.e., tiered) away from the article (i.e., in the open position), where the drawers themselves delimit the edge of the front wall of the article.

Referring to FIG. 15, a chest of drawers 110 is shown comprising applied multiple vertical, multicolored, molded picture frames 95 on the exterior surface, which chest contains a plurality of extended drawers 96, 97, 98, 99. Here the drawers 96, 97, 98, 99 delimit an edge 101 of the front wall 102 and a sidewall 103 of the chest of drawers 110. The drawers 96, 97, 98, 99 are slide-ably extendable/retractable away from the front wall 102 of the article 110. The drawers 96, 97, 98, 99 may be operatively connected to the first 103 and second 104 sidewalls of the chest 110. In this figure, the drawers 96, 97, 98, 99 are extended in a tier configuration.

Figure 16:
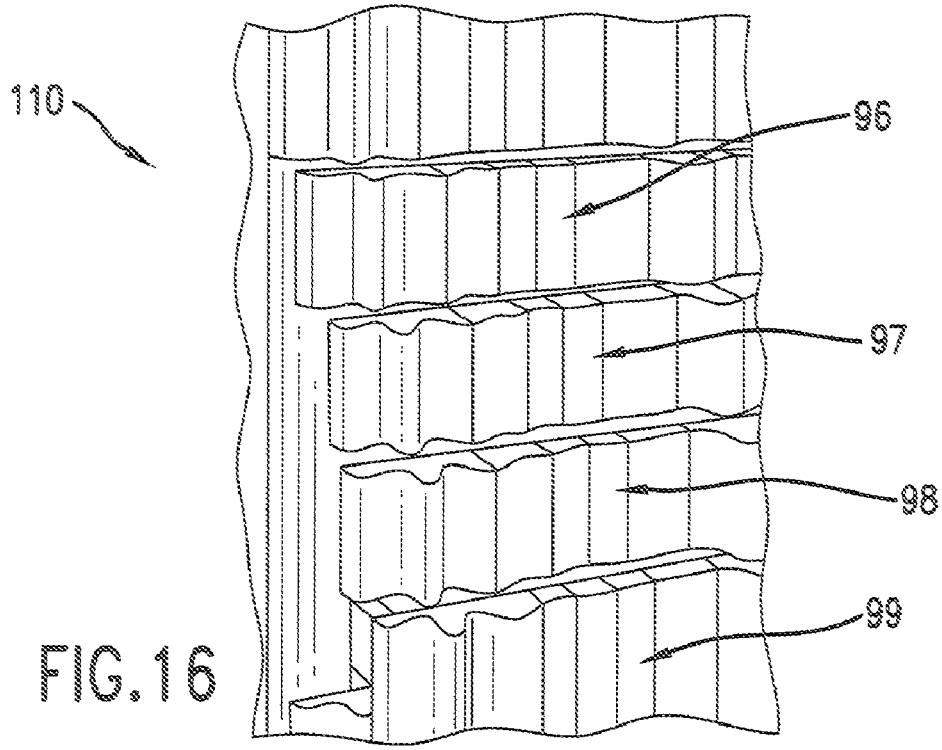
FIG. 16 is another perspective view of the chest of draws of FIG. 15.
Figure 17:
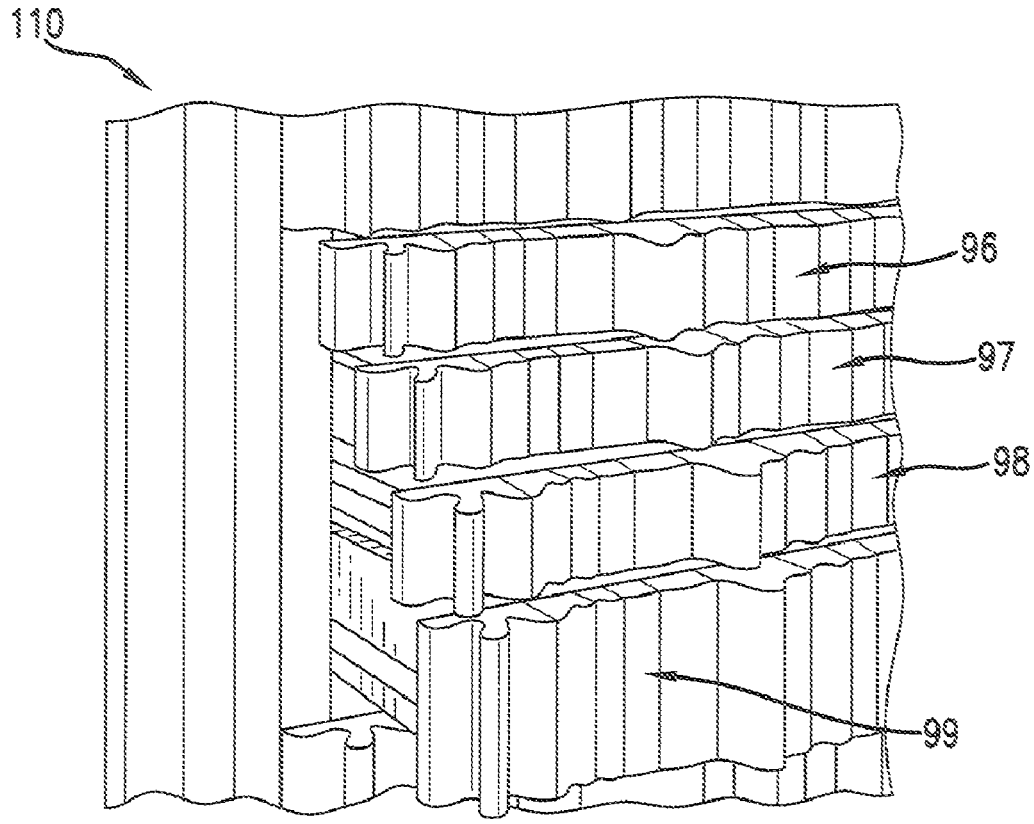
FIG. 17 is another perspective view of the chest of draws of FIG. 15.
Figure 18:
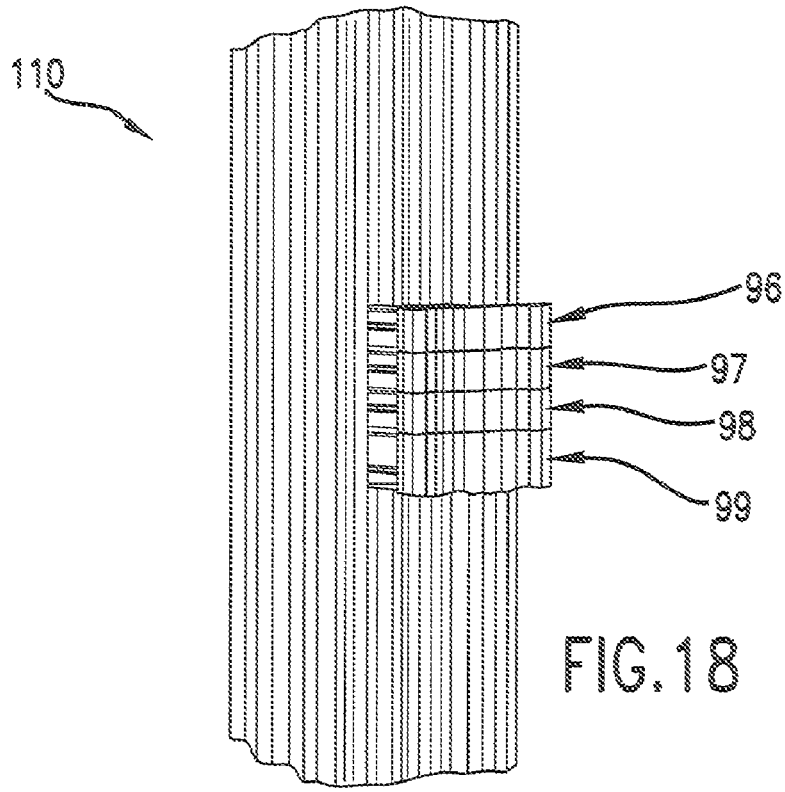
FIG. 18 is a perspective view of a chest of drawers having vertically parallel, multi-colored, multi-banded frames, where the drawers are horizontally extended (i.e., evenly) away from the article (i.e., in the open position), where the drawers themselves delimit the edge of the front of the article.

FIGS. 16-18 show the chest 110 of FIG. 15 with drawers 96, 97, 98, 99 in various configurations.

It will be apparent to those of skill in the art that numerous variations in addition to those discussed above are also possible. Therefore, while the invention has been described with respect to certain specific embodiments, it will be appreciated that many modifications and changes may be made by those skilled in the art without departing from the spirit of the invention. It is intended therefore, by the appended claims to cover all such modifications and changes as fall within the true spirit and scope of the invention.

Furthermore, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is not intended to be limiting as to the scope of the present invention in any way.

What is claimed is:

1. A furniture article comprising:

a furniture body, the furniture body having at least one exterior surface, the at least one exterior surface comprising a movable portion and a stationary portion; and a plurality of molding portions attached to and substantially completely covering the exterior surface, wherein molding portions attached to the movable portion are of a same width, profile, and orientation as corresponding nearest molding portions attached to the stationary portion, thereby obscuring the movable portion;

wherein the molding portions have an outward facing surface opposite a surface attached to the furniture article that is substantially uniform along an entirety of a major axis and substantially non uniform along an axis perpendicular to the major axis.

2. The furniture article of claim 1, wherein the at least one exterior surface comprises a plurality of movable portions and wherein each of the movable portions has molding portions attached thereto that are of a same width, profile and orientation as corresponding nearest molding portions attached to the stationary portion.

3. The furniture article of claim 2, wherein the furniture body has a plurality of vertical exterior surfaces and each of the plurality of vertical exterior surfaces is substantially completely covered with molding portions.

4. The furniture article of claim 3, wherein the molding portions are oriented vertically.

5. The furniture article of claim 1, wherein the molding portions are oriented vertically.

6. The furniture article of claim 1, wherein the at least one exterior surface comprises a plurality of movable portions.

7. The furniture article of claim 1, wherein the furniture body has a plurality of vertical exterior surfaces and each of the plurality of vertical exterior surfaces is substantially completely covered with molding portions.

8. The furniture article of claim 1, wherein the molding portions are oriented horizontally.

9. The furniture article of claim 8 further comprising a second exterior surface, wherein a second molding portion on the second exterior surface has a same shape and color as a corresponding first molding portion on the movable portion, and wherein an end of the first molding portion and an adjoining end of the second molding portion are beveled with an angle of a bevel on the end of the first molding portion being complementary to an angle of a bevel on the end of the second molding portion.

10. A method for manufacturing a furniture article comprising:

covering an exterior surface of a body of a furniture article substantially entirely with a plurality of molding portions, the exterior surface of the body including at least one movable portion and at least one stationary portion, such that a plurality of molding portions are attached to the movable portion and are of a same width, profile, and orientation as corresponding nearest molding portions attached to the stationary portion, thereby obscuring the movable portion;

wherein each of the molding portions has a major axis, and the major axis of each molding portion covering the surface is substantially parallel to other molding portions covering the surface; and wherein the molding portions have an outward facing surface opposite a surface attached to the furniture article that is substantially uniform along the major axis and substantially non uniform along an axis perpendicular to the major axis.

11. The method of claim 10, wherein the stationary portion being covered substantially entirely by the molding portions, the major axis of each molding portion covering the stationary portion being substantially parallel to other molding portions covering the movable portion.

12. The method of claim 10, wherein the exterior surface comprises a plurality of movable portions.

13. The method of claim 10, wherein the body has a plurality of vertical exterior surfaces and each of the plurality of vertical exterior surfaces is substantially completely covered with molding portions.

14. Method of claim 10, wherein the molding portions are oriented vertically.

15. The method of claim 10, wherein the molding portions are oriented horizontally.

16. The method of claim 15, wherein the furniture article comprises a second exterior surface, wherein a second molding portion on the second exterior surface has a same shape and color as a corresponding first molding portion on the movable portion, and wherein an end of the first molding portion and an adjoining end of the second molding portion are beveled with an angle of a bevel on the end of the first molding portion being complementary to an angle of a bevel on the end of the second molding portion.

* * * * *